US006053495A

United States Patent [19]

Hara et al.

[11] Patent Number: 6,053,495

[45] Date of Patent: Apr. 25, 2000

[54] MULTIPLE FEED DETECTING SYSTEM

[75] Inventors: Yoshikazu Hara; Masakazu Miyata; Masahiro Nishihata, all of Ibaraki-ken, Japan

[73] Assignee: Riso Kagaku Corporation, Tokyo, Japan

[21] Appl. No.: 09/106,861

[22] Filed: Jun. 30, 1998

[30] Foreign Application Priority Data

Jul. 2, 1997 [JP] Japan ..... 9-177441

[51] Int. Cl.[7] ..... B65H 7/12

[52] U.S. Cl. ..... 271/263; 271/262; 271/265.04; 271/258.01

[58] Field of Search ..... 271/262, 263, 271/265.04, 258.01

[56] References Cited

U.S. PATENT DOCUMENTS

| | | | |
|---|---|---|---|
| 3,882,308 | 5/1975 | Daughton et al. | 250/222 |
| 4,154,437 | 5/1979 | Butcheck et al. | 271/263 X |
| 4,471,954 | 9/1984 | Bourg | 270/58 |
| 5,131,648 | 7/1992 | Ito | 271/262 |
| 5,238,123 | 8/1993 | Tovini et al. | 271/262 X |
| 5,384,631 | 1/1995 | Matsunami | 355/308 |
| 5,437,445 | 8/1995 | Chang et al. | 271/263 |
| 5,820,713 | 10/1998 | Iddon | 271/263 X |

FOREIGN PATENT DOCUMENTS

| | | | |
|---|---|---|---|
| 0 596 606 A1 | 5/1994 | European Pat. Off. . | |
| 0 691 297 A2 | 1/1996 | European Pat. Off. . | |
| 0053365 | 4/1977 | Japan | 271/263 |
| 363185754 | 8/1988 | Japan | 271/263 |

*Primary Examiner*—David H. Bollinger
*Assistant Examiner*—Richard Ridley
*Attorney, Agent, or Firm*—Nixon Peabody LLP; Donald R. Studebaker

[57] ABSTRACT

A multiple feed detecting system is provided with a sheet thickness sensor which outputs thickness signals representing the thickness of a sheet to be conveyed, and a sheet size sensor which detects the size of the sheet to be conveyed as measured in the direction of conveyance. A detecting area is set according to the size of the sheet detected and whether multiple feed occurs is determined on the basis of sampling data obtained by the sheet thickness detecting sensor over the detecting area set.

10 Claims, 19 Drawing Sheets

MULTIPLE FEED DETECTING SYSTEM

BACKGROUND OF THE INVENTION

1. Field of the Invention

This invention relates to a multiple feed detecting system for detecting multiple feed of sheets, that is, that a plurality of sheets are conveyed along a conveyance passage one on another, in printers, copiers or the like.

2. Description of the Related Art

For example, a paper feed mechanism in printers separates and conveys sheets one by one from a sheet stack. However a plurality of sheets sometimes can be fed to the printing drum superposed or overlapped one on another. This phenomenon will be referred to as "multiple feed", hereinbelow. In order to accurately detect such multiple feed, sampling is generally effected over a wide area of the sheet to be fed.

FIG. 19 shows a light transmission type multiple feed detector provided to the paper feed mechanism. The multiple feed detector 1 comprises a light emission sensor 1*a* and a light reception sensor 1*b* opposed to each other intervening therebetween a sheet 11. The sheet 11 is disposed in the middle between the sensors 1*a* and 1*b* preferably in perpendicular to the line joining the sensors 1*a* and 1*b* so that change in transmittance due to reflected light or the like can be suppressed.

When detecting multiple feed of the sheets 11 by the above arrangement, there is an area of the sheet 11 which is not suitable for sampling. FIG. 20 shows a state where the sheet 11 is slackened by resist rollers 9 at the beginning of feed shown in FIG. 19. In the state shown in FIG. 20, the sheet 11 cannot be positioned in the middle between the sensors 1*a* and 1*b* and sometimes cannot be in perpendicular to the line joining the sensors 1*a* and 1*b*. FIG. 21 shows a state where the sheet 11 is released from a pickup roller 8 at the end of feed. Also in this state, the above problem occurs.

Thus, the leading end portion and the trailing end portion of the sheet 11 are instable in position relative to the detector 1 and accordingly are not suitable for sampling for detecting multiple feed. When such a portion is sampled, detecting accuracy deteriorates.

When sampling only an intermediate portion of the sheet 11, the sheet size gives rise to a problem. FIG. 22 shows the sampling timings of the light reception sensor 1*b* when an A-3 sheet and an A-5 sheet are fed by the paper feed mechanism shown in FIG. 19.

Sampling the A-5 sheet over the sampling area for the A-3 sheet results in sampling a vacant area. To the contrast, sampling the A-3 sheet over the sampling area for the A-5 sheet results in sampling over an area narrower than available.

SUMMARY OF THE INVENTION

In view of the foregoing observations and description, the primary object of the present invention is to provide a multiple feed detecting system which can overcome the problems described above and detects multiple feed at a high accuracy determining an optimal sampling area according to the size of the sheet.

In accordance with the present invention, there is provided a multiple feed detecting system comprising a sheet thickness detecting means which outputs thickness signals representing the thickness of a sheet to be conveyed, a sheet size detecting means which detects the size of the sheet to be conveyed as measured in the direction of conveyance, and a processing means which sets a detecting area according to the size of the sheet detected by the sheet size detecting means and determines multiple feed on the basis of sampling data obtained by the sheet thickness detecting means over the detecting area set.

The sheet size detecting means may output a sheet size signal representing the size of the sheet to be conveyed as measured in the direction of conveyance on the basis of a state of a change-over switch on a control panel.

The sheet size detecting means may be provided on a container in which the sheets to be conveyed are contained and may output a sheet size signal representing the size of the sheets in the direction of conveyance contained in the container.

In one embodiment, the processing means determines the sheet size in the direction of conveyance according to sampling data obtained by the sheet thickness detecting means and changes the detecting area of the sheet thickness detecting means according to the sheet size thus determined.

In another embodiment of the present invention, the processing means determines whether multiple feed occurs on the basis of comparison of the sampling data for the current sheet obtained by the sheet thickness detecting means over the detecting area with the sampling data for a preceding sheet obtained by the sheet thickness detecting means over the detecting area.

In still another embodiment of the present invention, the sheet thickness detecting means is provided on a path of conveyance between a first conveyance means which separates a sheet from a sheet stack on a stack table and conveys the separated sheet and a second conveyance means which receives the sheet conveyed from the first conveyance means and conveys it downstream.

In one embodiment, the sheet thickness detecting means comprises a light transmission type sensor.

In another embodiment, the sheet thickness detecting means comprises a light reflection type sensor.

In still another embodiment, the sheet thickness detecting means comprises an ultrasonic sensor.

In still another embodiment, the sheet thickness detecting means comprises a contact type sensor.

In the multiple feed detecting system of the present invention, the sampling area of the sheet to be conveyed is determined on the basis of information from a means for detecting the size of the sheet to be conveyed as measured in the direction of conveyance or means for designating the size of the sheet to be conveyed as measured in the direction of conveyance, and accordingly so long as the sheet to be conveyed is of a regular size, an optical sampling area can be obtained and multiple feed detection can be carried out at a high accuracy.

Further since sampling is effected at a plurality points arranged in the direction of conveyance of the sheet during printing (or feed of sheet) and the sheet size in the direction of conveyance is calculated on the basis of the sampling data and the data on the area obtained by subtracting from the sheet size the instable areas in the leading and trailing end portions of the sheet is used for detecting multiple feed, an optimal sampling area can be obtained according to the sheet size and multiple feed detection can be carried out at a high accuracy.

As the sheet thickness detecting means, any one of a photosensor of a transmission type or reflective type, an ultrasonic sensor and a contact type sensor may be used. In the case where a photosensor is used, the sheet size in the direction of conveyance can be easily calculated by storing the intensity of received light before initiation of conveyance of sheet and using it in calculation of the sheet size.

DESCRIPTION OF THE PREFERRED EMBODIMENTS

First Embodiment

Figure 1:
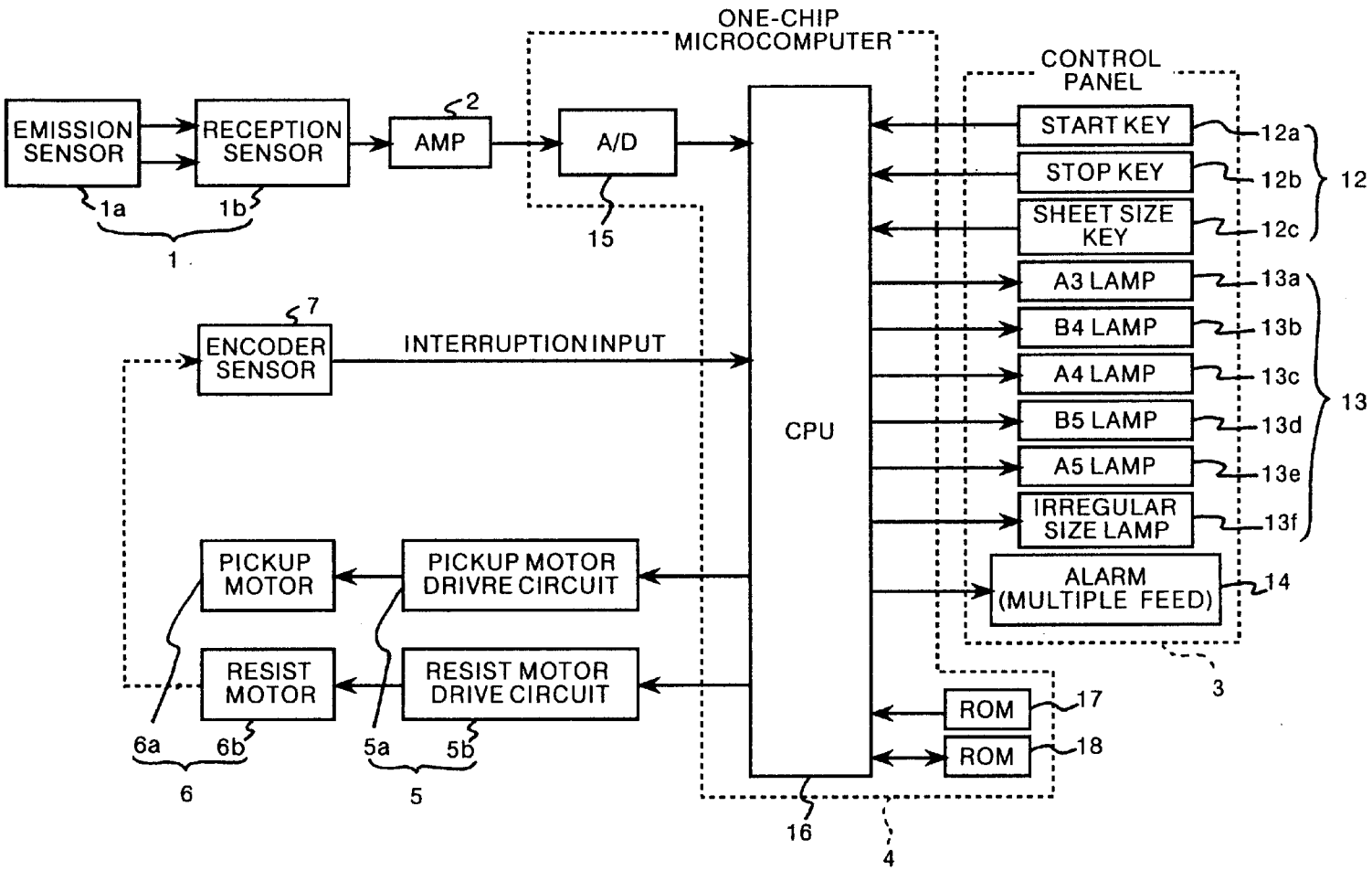
FIG. 1 is a block diagram showing a multiple feed detecting system in accordance with a first embodiment of the present invention.
Figure 2:
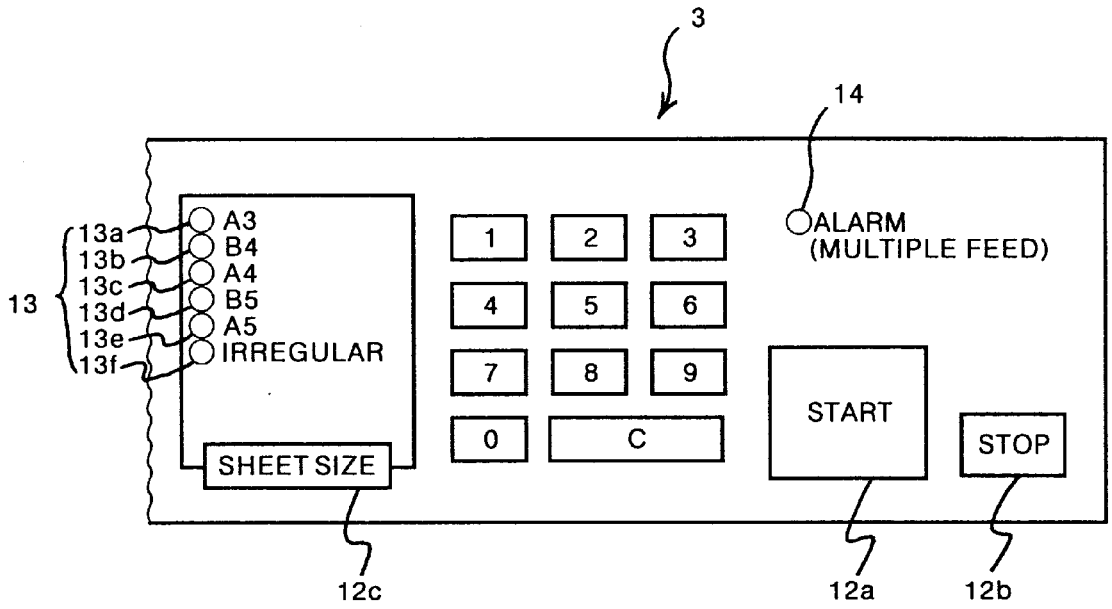
FIG. 2 is a view of a control panel employed in the first embodiment.
Figure 3:
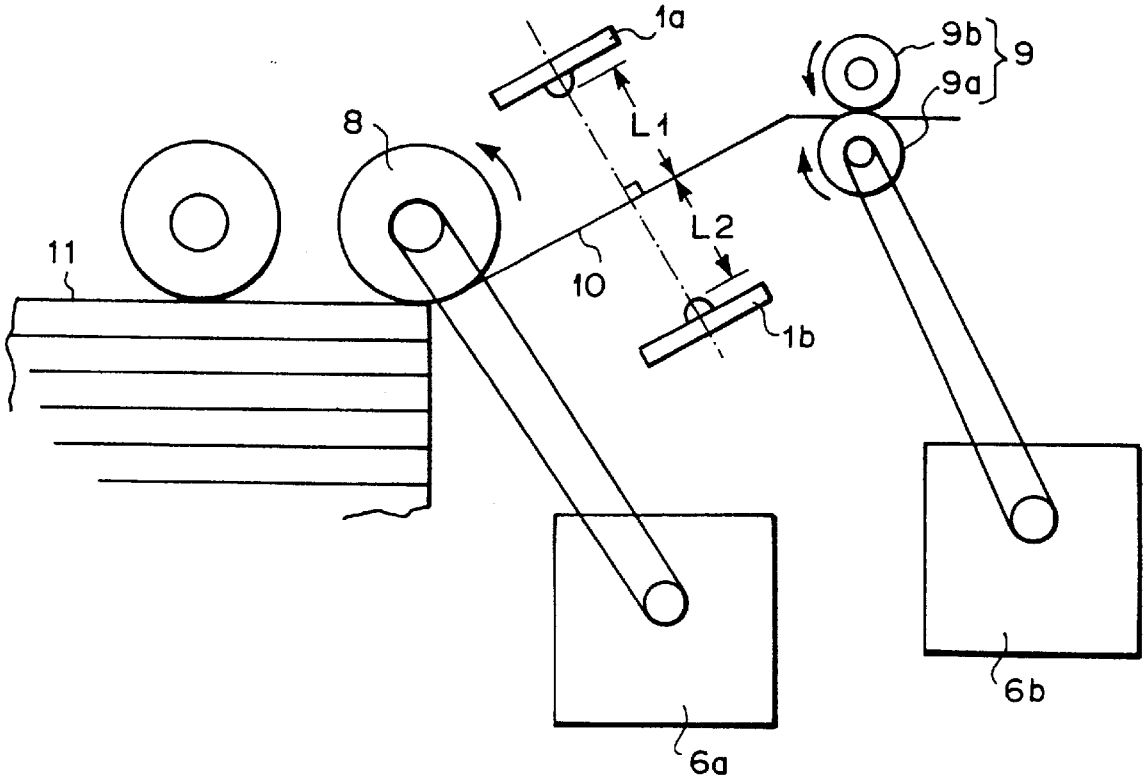
FIG. 3 is a view showing an arrangement of motors.

FIG. 1 is a block diagram showing a multiple feed detecting system in accordance with a first embodiment of the present invention as applied to a printer, FIG. 2 is a view of a control panel employed in the first embodiment, and FIG. 3 is a view showing an arrangement of motors in the multiple feed detecting system of the first embodiment.

A multiple feed detecting system in accordance with a first embodiment of the present invention comprises a sheet thickness detecting means 1, an amplifier 2, a control panel 3, a microcomputer 4, a drive circuit 5, a conveyor motor system 6 and an encoder sensor 7.

The sheet thickness detecting means 1 is of a light transmission type comprising a light emission sensor 1*a* and a light reception sensor 1*b*. The light emission sensor 1*a* may comprise, for instance, a light emission diode, a laser diode, a lamp or the like. As shown in FIG. 3, the light emission sensor 1*a* is disposed above a conveyance path 10, inclining upward rightword, between a pickup roller 8 and resist rollers 9 at a distance L1 from the path 10.

The light reception sensor 1*b* may comprise, for instance, a photodiode. As shown in FIG. 3, the light reception sensor 1*b* is disposed below the conveyance path 10 at a distance L2 (=L1) from the path 10 and is opposed to the light emission sensor 1*a*.

Light emitted from the light emission sensor 1*a* is directly received by the light reception sensor 1*b* when there is no sheet on the conveyance path 10. When the sheet 11 is on the conveyance path 10, light passing through the sheet 1 is received by the light reception sensor 1*b*. The light received by the light reception sensor 1*b* is converted to an electric signal corresponding to the amount of light received and is input into the amplifier 2.

The amplifier 2 amplifies the electric signal input from the light reception sensor 1*b* at a predetermined amplification factor and inputs the amplified electric signal into the microcomputer 4.

The control panel 3 is provided with control keys 12 (a start key 12*a*, a stop key 12*b* and a sheet size key 12*c*), sheet size lamps 13, a multiple feed alarm lamp 14 and ten keys for setting the number of printings. The control keys 12 are selectively operated by the user. The start key 12*a* is for starting printing, the stop key 12*b* is for interrupting printing and the sheet size key 12*c* is for designating the sheet size (A3, B4, A4, B5, A5 and irregular sizes) to be used.

The sheet size lamps 13 includes an A3 lamp 13*a*, a B4 lamp 13*b*, an A4 lamp 13*c*, a B5 lamp 13*d*, an A5 lamp 13*e* and an irregular size lamp 13*f* and one of the lamps is turned on according to the sheet size used under the control of the microcomputer 4.

The multiple feed alarm lamp 14 is turned on under the control of computer 4 when it is determined that multiple feed occurs.

The microcomputer 4 is formed of a one-chip microcomputer comprising an A/D convertor 15, a CPU 16 (a processing means), a ROM 17 and a RAM 18 (storage means).

The A/D convertor 15 converts the electric signal input from the amplifier 2 to a digital signal and inputs the digital signal into the CPU 16.

The CPU 16 comprises a microprocessor and the like and executes control of conveyance of the sheet 11, determination of the sheet size, switching of sheet size display, set of the sampling area, detection of multiple feed of the sheets 11, and the like on the basis of information from the control panel 3, signals from the amplifier 2, signals from the encoder sensor 7 and the like.

Specifically the CPU 16 determines the sheet size on the basis of sheet size information from the sheet size key 12*c* on the control panel 3 and turns on one of the sheet size lamps 13 and sets the sampling area for the sheet thickness detecting means 1 according to the sheet size.

The CPU 16 samples digital signals from the A/D convertor 15 at timings in synchronization with input of interruption signals from the encoder sensor 7.

The CPU 16 determines whether multiple feed occurs by sampling data based on the sheet thickness detecting means 1 and turns on and off the alarm lamp 14 on the basis of the result of determination.

The CPU 16 outputs instruction for driving and stopping the conveyor motor system 6 to the drive circuit 5 on the basis of a signal from the start key 12*a* and the stop key 12*b* on the control panel 3.

The CPU 16 is provided therein with a paper counter and increments the counter one by one each time an interruption signal is input from the encoder sensor 7.

The ROM 17 stores processing programs necessary for the CPU 16 to perform a series of processing and data on the sampling areas for the respective sheet sizes.

The RAM 18 stores sampling data for a first sheet 11 in the sampling area set by the CPU 16 and serially updates the sampling data with the sampling data for the subsequent sheets. The RAM 18 stores the count of the paper counter in the CPU 16.

The drive circuit 5 comprises a pickup motor drive circuit 5*a* and a resist motor drive circuit 5*b*. The pickup motor drive circuit 5*a* rotates and stops a pickup motor 6*a* (to be described later) on the basis of instruction from the CPU 16. The resist motor drive circuit 5*b* rotates and stops a resist motor 6*b* (to be described later) on the basis of instruction from the CPU 16.

The conveyor motor system 6 comprises the pickup motor 6*a* which connected to the pickup roller 8 by way of a drive belt and the resist motor 6*b* connected to the resist rollers 9 by way of a drive belt.

The pickup motor 6*a* drives the pickup roller 8 which separates a sheet 11 from a stack of sheets of the same quality on a sheet feed table and conveys it.

The resist motor 6*b* drives a pair of resist rollers 9 which take up the sheet 11 fed by the pickup roller 8 and conveys it toward a printing drum (not shown).

The encoder sensor 7 outputs a one-shot pulse signal each time the resist motor 6*b* rotates by an angle corresponding to feed of the sheet 11 by a predetermined length (e.g., 1 mm). The one-shot pulses are input into the CPU 16 of the microcomputer 4 as the interruption signals.

Second Embodiment

Figure 4:
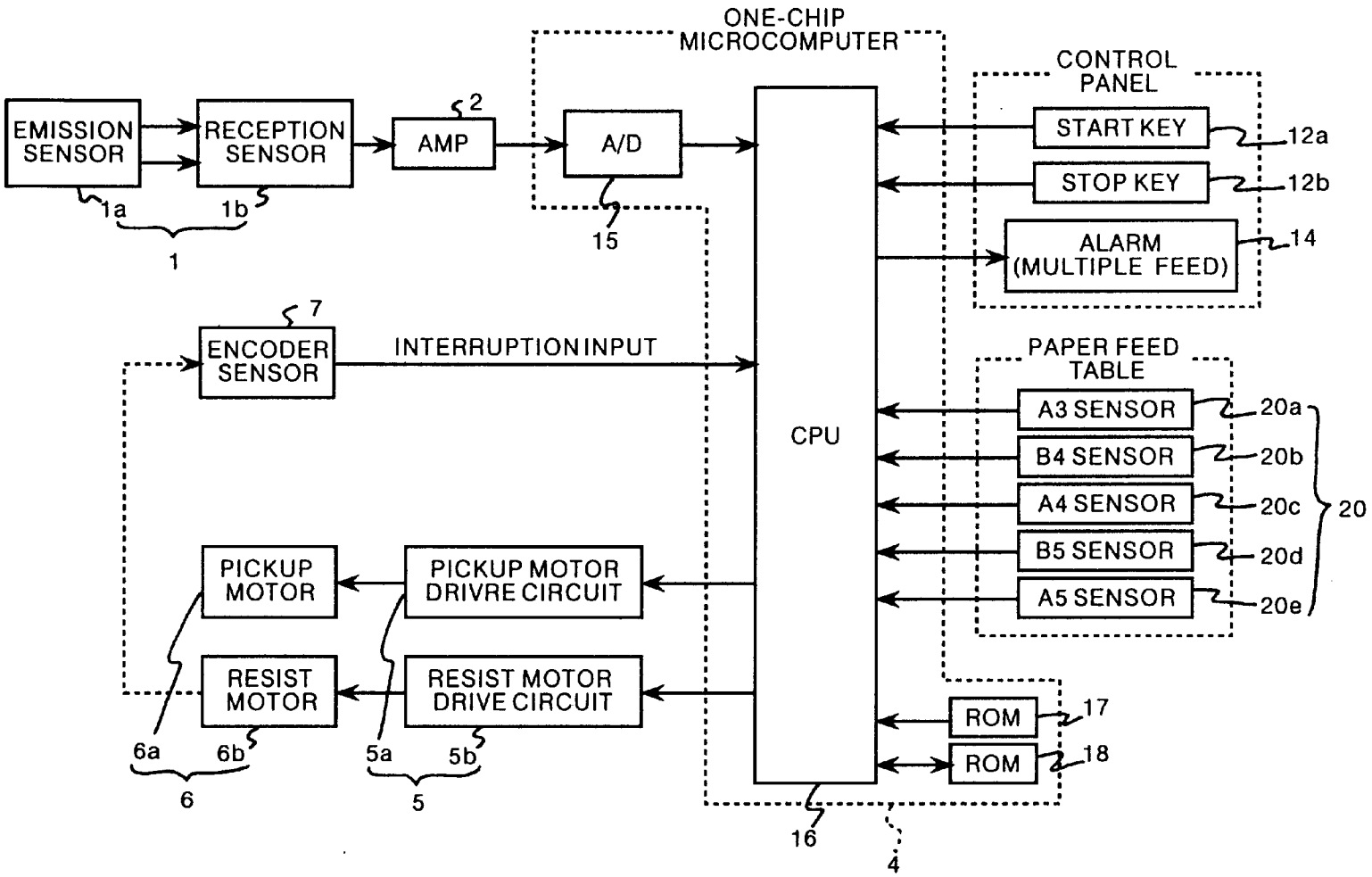
FIG. 4 is a block diagram showing a multiple feed detecting system in accordance with a second embodiment of the present invention.
Figure 5:
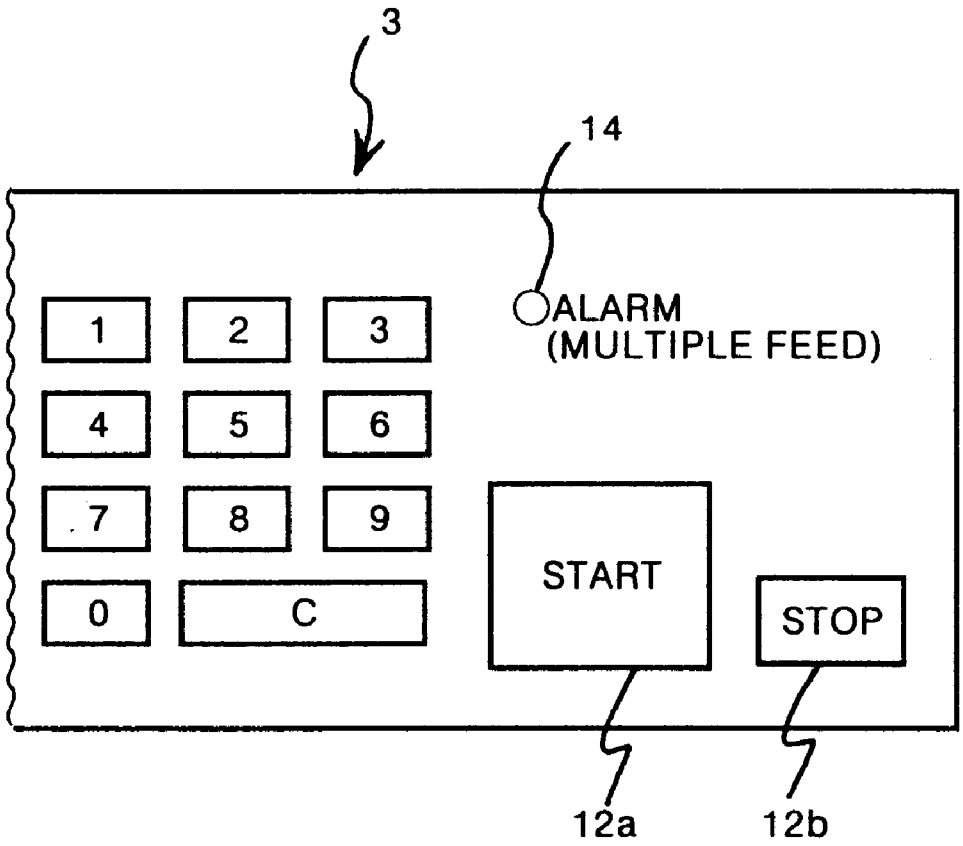
FIG. 5 is a view of a control panel employed in the second embodiment.

A multiple feed detecting system in accordance with a second embodiment of the present invention will be described with reference to FIGS. 4 to 6, hereinbelow. The elements analogous to those of the first embodiment are given the same reference numerals and will not be described here.

In the second embodiment, the control panel 3 is not provided with the sheet size key and the sheet size lamp which are provided in the first embodiment.

Figure 6:
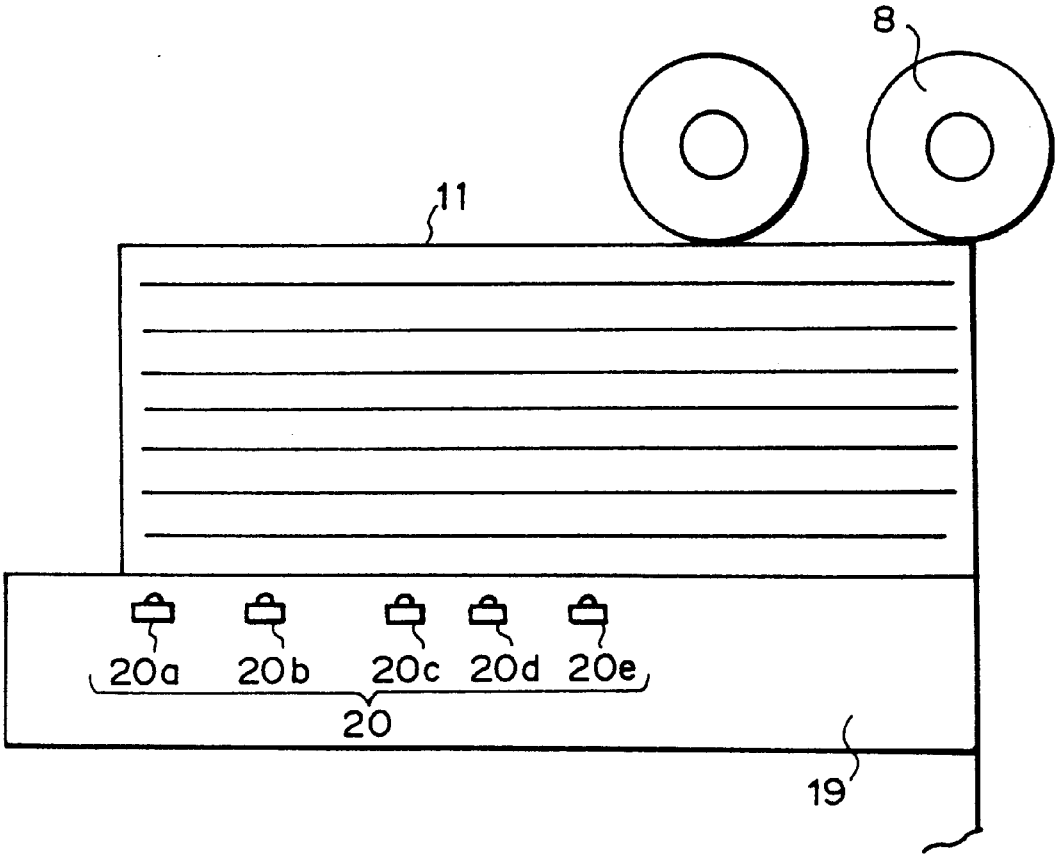
FIG. 6 is a view showing the arrangement of the sheet size detecting means employed in the second embodiment.
Figure 7:
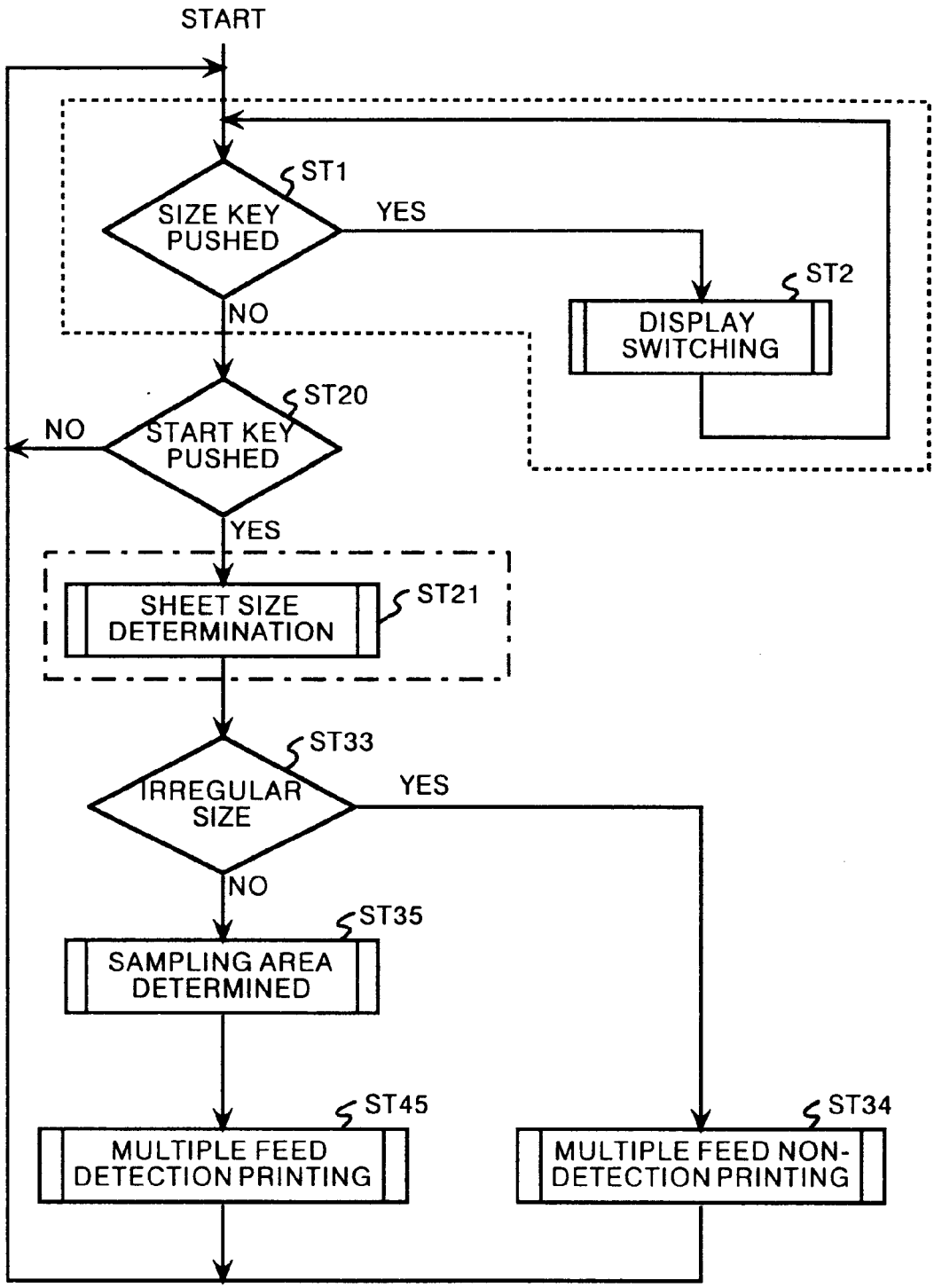
FIG. 7 is a flow chart for illustrating the operation of the first and second embodiments.

As shown in FIG. 6, a sheet size sensor system 20 is provided on a sheet feed table 19 on which the stack of the sheets 11 is placed. The sheet size sensor system 20 comprises an A3 sensor 20*a*, a B4 sensor 20*b*, an A4 sensor 20*c*, a B5 sensor 20*d* and an A5 sensor 20*e*. Each of the sensor 20*a* to 20*e* may comprise, for instance, a reflective optical sensor provided with a light emission sensor and a light reception sensor integrated with each other and outputs a signal according to whether a sheet 11 exists on the detecting surface thereof.

For example, when the sheets 11 on the sheet feed table 19 is of A4 size, the A4 sensor 20*c*, the B5 sensor 20*d* and the A5 sensor 20*e* output signals (e.g., binary signal of "1") representing that a sheet exists thereon to the CPU 16 of the microcomputer 4. On the other hand, since there exists no sheet on the A3 sensor 20*a* and the B4 sensor 20*b*, they outputs signals (e.g., binary signal of "0") representing that no sheet exists thereon to the CPU 16 of the microcomputer 4.

The CPU 16 determines the sheet size, in the direction of conveyance, of the sheets 11 on the sheet feed table 19 on the basis of the signals from the sheet size sensor system 20.

The operation of the multiple feed detecting systems of the first and second embodiments will be described with reference to flow charts shown in FIGS. 7 to 12. In the flow chart shown in FIG. 7, the part of processing which is to be executed only in the first embodiment is enclosed with the dashed line and that which is to be executed only in the second embodiment is enclosed with the chained line. The sheet feed table 19 is movable up and down by a mechanism not shown and it is assumed that a stack of sheets 11 of the same quality is placed on the sheet feed table 19.

Figure 8:
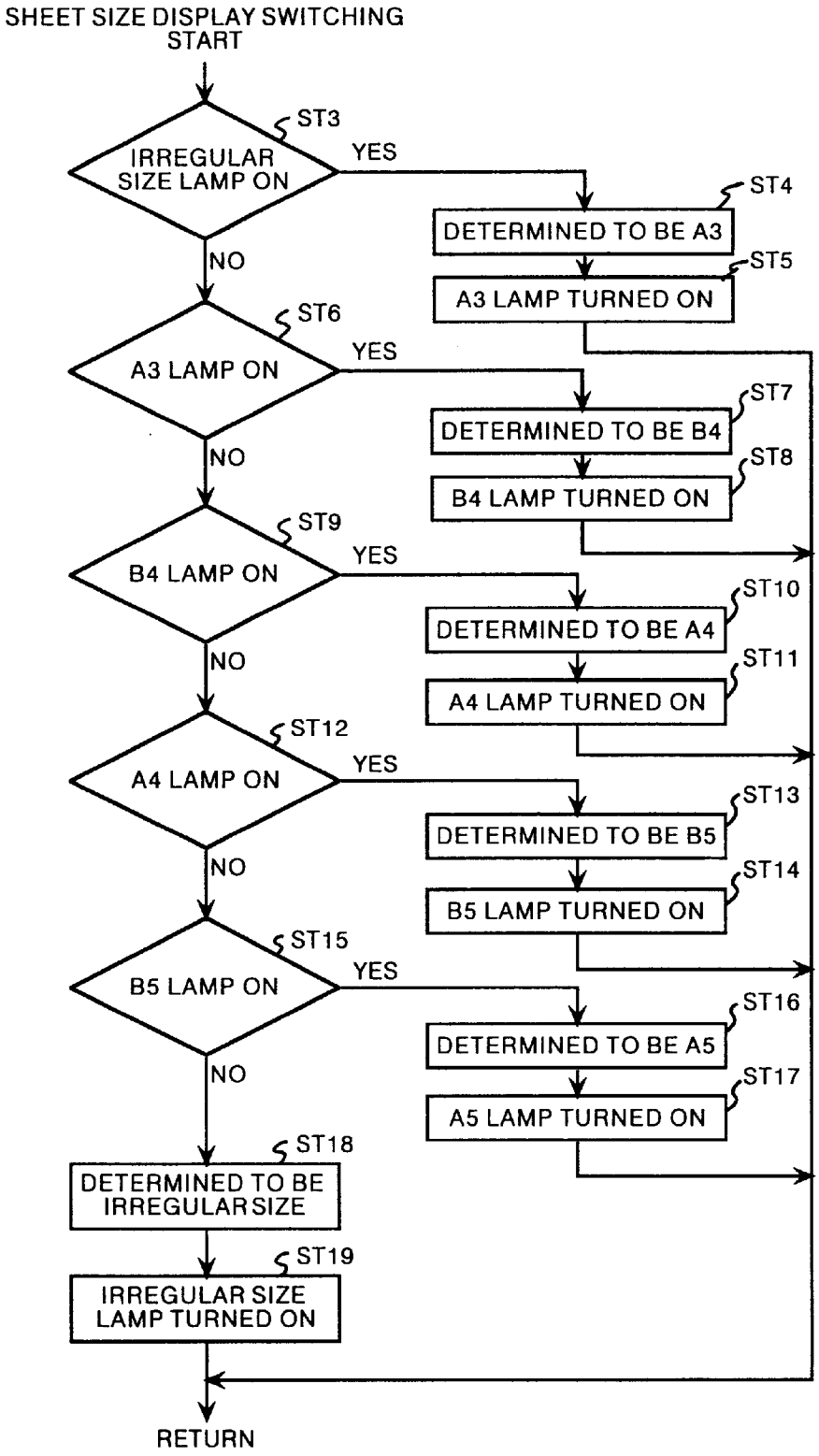
FIG. 8 is a flow chart for illustrating the operation of switching the sheet size display in the first embodiment.

When the start key 12*a* is pushed, printing is started. In the case of the first embodiment, prior to (or in parallel to) determining whether the start key 12*a* has been pushed, it is determined whether the sheet size key 12*c* has been pushed. (ST1) When it is determined that the sheet size key 12*c* has been pushed, the operation of switching the sheet size display shown in FIG. 8 is performed. (ST2)

In the operation of switching the sheet size display, each time the sheet size key 12*c* is pushed, the selected size is switched in sequence in the order of A3→B4→A4→B5→A5→ irregular size→A3, and one of the sheet size lamps 13 corresponding to the sheet size thus selected is turned on.

In the flow chart shown in FIG. 8, when the irregular size lamp 13*f* is on at the time the sheet size key 12*c* is pushed (ST3:YES), it is determined that the sheet size is A3 (ST4) and the A3 lamp 13*a* is turned on (ST5). When the A3 lamp 13*a* is on (ST6:YES), it is determined that the sheet size is B4 (ST7) and the B4 lamp 13*b* is turned on (ST8). When the B4 lamp 13*b* is on (ST9:YES), it is determined that the sheet size is A4 (ST10) and the A4 lamp 13*c* is turned on (ST11). When the A4 lamp 13*c* is on (ST12:YES), it is determined that the sheet size is B5 (ST13) and the B5 lamp 13*d* is turned on (ST14). When the B5 lamp 13*d* is on (ST15:YES), it is determined that the sheet size is A5 (ST16) and the A5 lamp 13*e* is turned on (ST17). When the B5 lamp 13*d* is not on (ST15:NO), that is, when the A5 lamp 13*e* is on, it is determined that the sheet size is an irregular size (ST18) and the irregular size lamp 13*f* is turned on (ST19).

Figure 9:
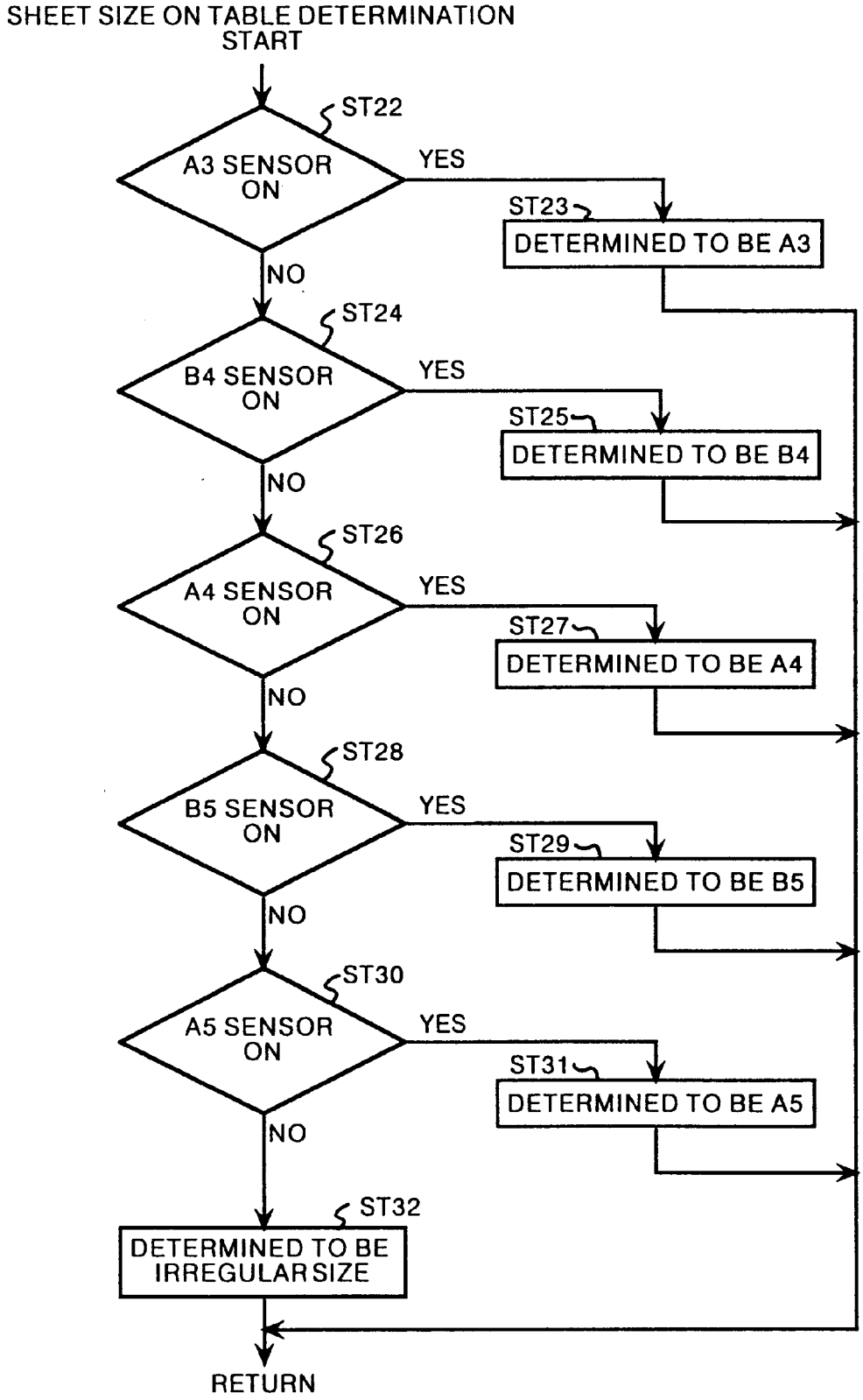
FIG. 9 is a flow chart for illustrating the operation of determining the size of the sheets on the sheet feed table in the second embodiment.

When the start key 12*a* is pushed (ST20:YES), (in the case of the second embodiment only), the operation of determining the size of the sheets on the sheet feed table shown in FIG. 9 is performed (ST21). In this operation, the size of the sheets 11 on the sheet feed table 19 is determined on the basis of the signals from the sheet size sensor system 20 shown in FIG. 6.

Since the arrangement shown in FIG. 6, the sensor for the size of the sheets 11 on the sheet feed table 19 and the sensors for the smaller sizes are all on, the sensor for the largest size (A3) is first checked.

In the flow chart shown in FIG. 9, when the A3 sensor 20*a* is on (ST22:YES), it is determined that the sheet size is A3 (ST23). When the A3 sensor 20*a* is not on (ST22:NO) and the B4 sensor 20*b* is on (ST24:YES), it is determined that the sheet size is B4 (ST25). When the B4 sensor 20*b* is not on (ST24:NO) and the A4 sensor 20*c* is on (ST26:YES), it is determined that the sheet size is A4 (ST27). When the A4 sensor 20*c* is not on (ST26:NO) and the B5 sensor 20*d* is on (ST28:YES), it is determined that the sheet size is B5 (ST29). When the B5 sensor 20*d* is not on (ST28:NO) and the A5 sensor 20*e* is on (ST30:YES), it is determined that the sheet size is A5 (ST30). When the At sensor 20*e* is off (ST30:NO), it is determined that the sheet size is an irregular size (ST32).

When the sheet size determined prior to initiation of printing in the operation of switching the sheet size display or the operation of determining the size of the sheets on the sheet feed table is an irregular size (ST33:YES), multiple feed non-detection printing operation is performed (ST34) since the multiple feed detecting area cannot be determined.

When the sheet size is not irregular (ST33:NO), the operation of determining the sampling area is performed (ST35). In this operation, the sampling area over which the sheet thickness detecting means 1 is to sample for detecting multiple feed is determined on the basis of the sheet size determined in the operation of switching the sheet size display or the operation of determining the size of the sheets on the sheet feed table.

Figure 10:
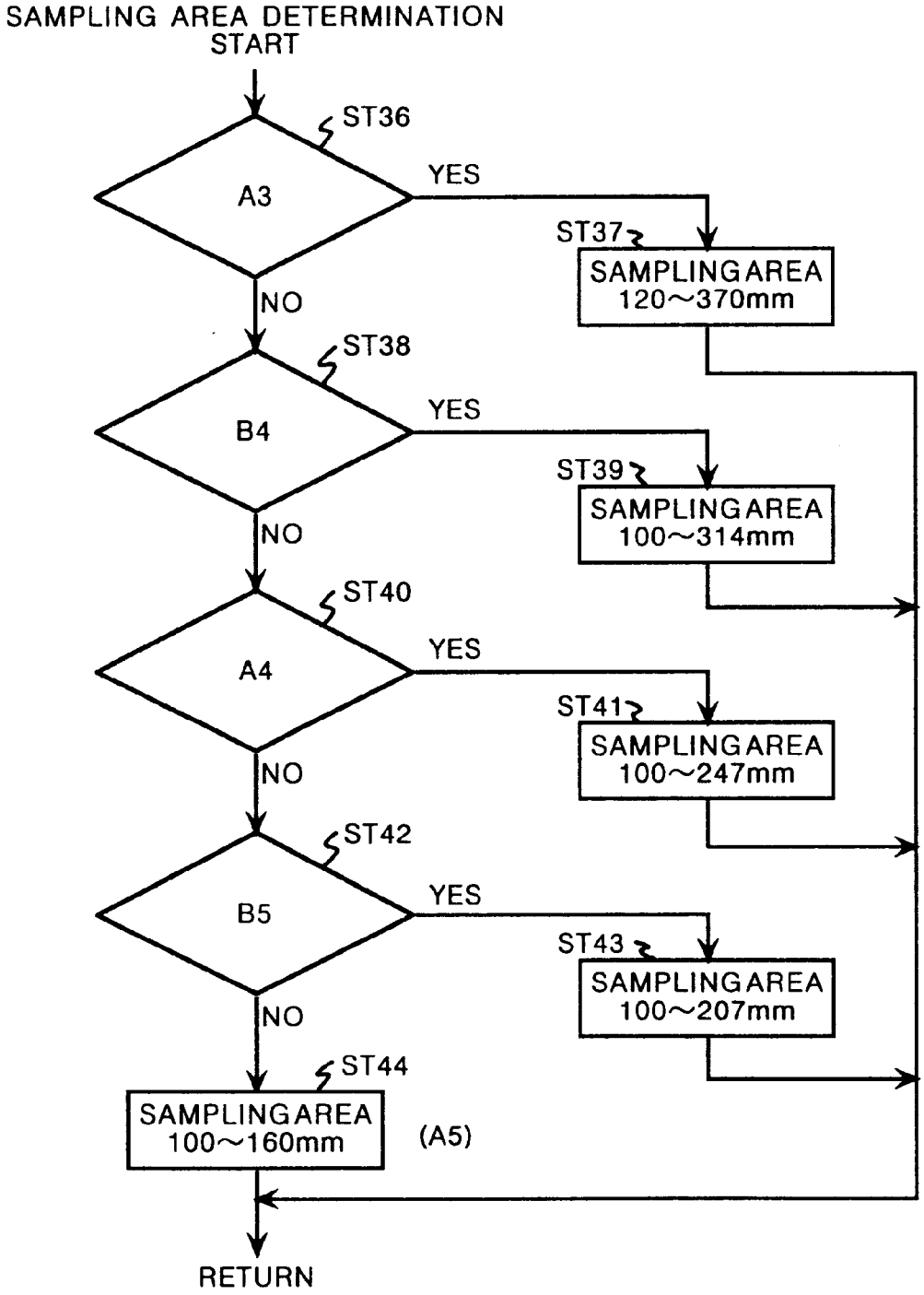
FIG. 10 is a flow chart for illustrating the operation of determining the sampling area in the first and second embodiments.

In the flow chart shown in FIG. 10, if the sheet size is A3 (ST36:YES), the sampling area is determined to be an area from 120 to 370 mm from the leading end (ST37). If the sheet size is B4 (ST38:YES), the sampling area is determined to be an area from 100 to 314 mm (ST39). If the sheet size is A4 (ST40:YES), the sampling area is determined to be an area from 100 to 247 mm (ST41). If the sheet size is B5 (ST42:YES), the sampling area is determined to be an area from 100 to 207 mm (ST43). If the sheet size is not B5, that is, if the sheet size is A5 (ST42:NO), the sampling area is determined to be an area from 100 to 160 mm (ST44).

In this embodiment, the sampling area is basically from a position at a distance of 100 mm from the leading end for each sheet size to a position at a distance of 50 mm from the trailing end. However the sampling area is limited to 250 mm in view of the capacity of the sampling data in the RAM 18 and/or the processing speed of the CPU 16. When such factors give rise to no problem, the sampling area may be enlarged. Conversely if the capacity of the sampling data in the RAM 18 is small and/or the processing speed of the CPU 16 is low, the sampling area may be narrowed.

In this embodiment, since the above limit is applied to the A3 sheet, the sampling area for the A3 sheet is narrowed to an area from a position at a distance of 120 mm from the leading end to a position at a distance of 50 mm from the trailing end. Though in this embodiment, cut 20 mm is added to the leading end side, it may be added to the trailing end side or may be shared to both the sides.

Figure 11:
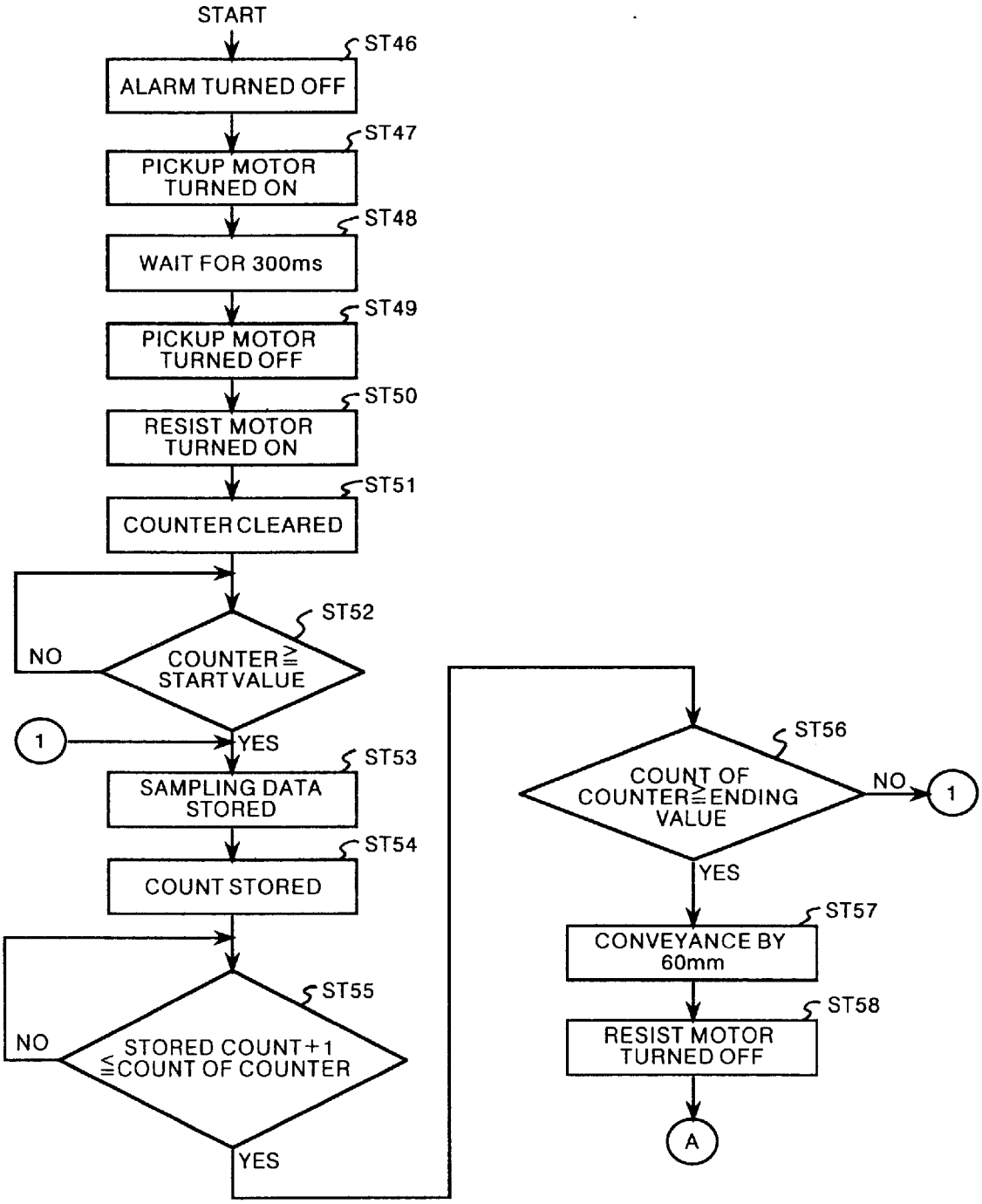
FIGS. 11 and 12 show a flow chart for illustrating the operation of detecting multiple feed and printing in the first and second embodiments.
Figure 12:
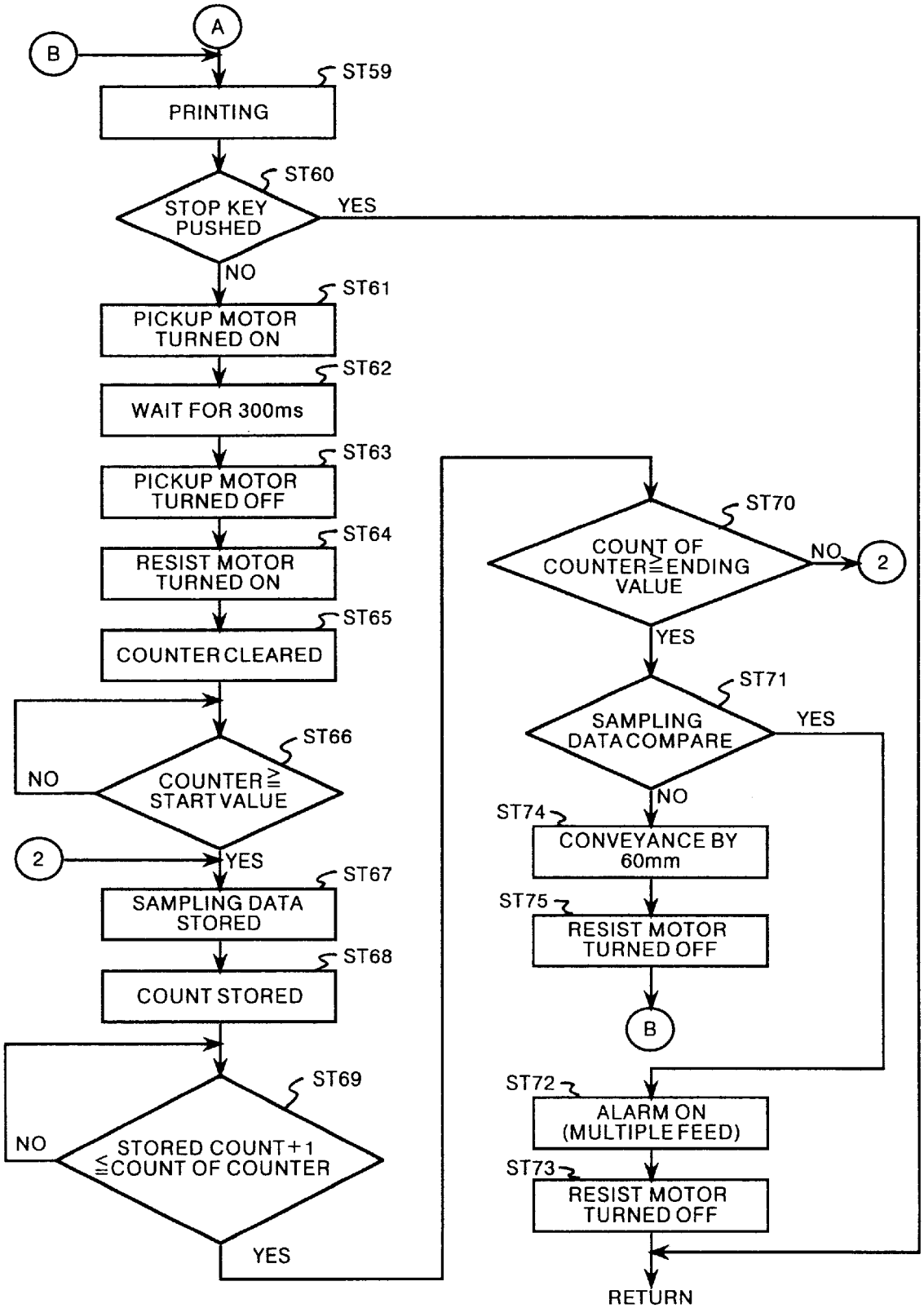

When the sampling area is thus determined, the operation of multiple feed detection printing shown in FIGS. 11 and 12 including sheet feed operation and multiple feed detection is performed.

In the flow chart shown in FIGS. 11 and 12, when the multiple feed alarm lamp 14 has been on, the lamp 14 is turned off (ST46). Then the pickup motor 6*a* is turned on (ST47) to rotate the pickup roller 8 in the direction of the arrow shown in FIG. 3. By this, the uppermost sheet 1 in the sheet stack on the sheet feed table is separated from the sheet stack and is conveyed.

Figure 20:
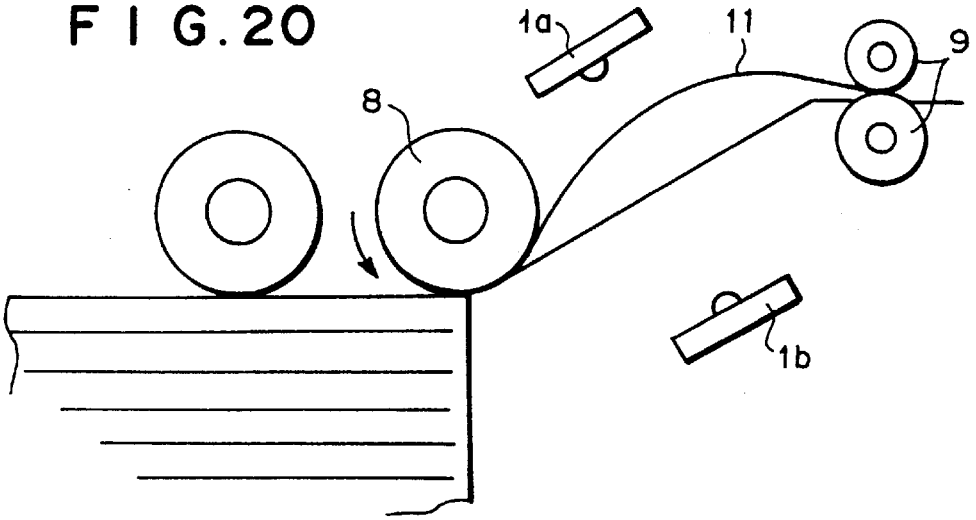
FIG. 20 is a view showing a state where the sheet is slackened at the beginning of feed in the mechanism shown in FIG. 19.
Figure 21:
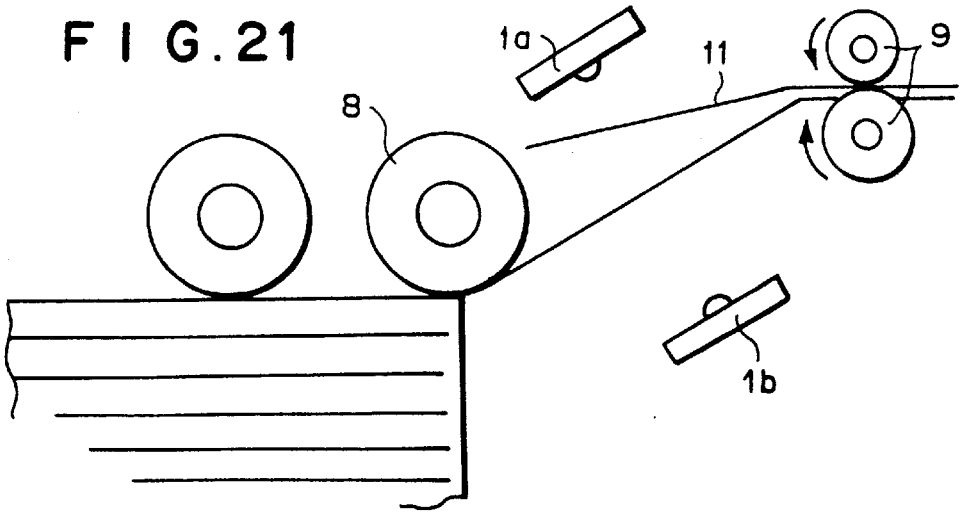
FIG. 21 is a view showing a state where the sheet is released from the pickup roller at the end of feed in the mechanism shown in FIG. 19.
Figure 22:
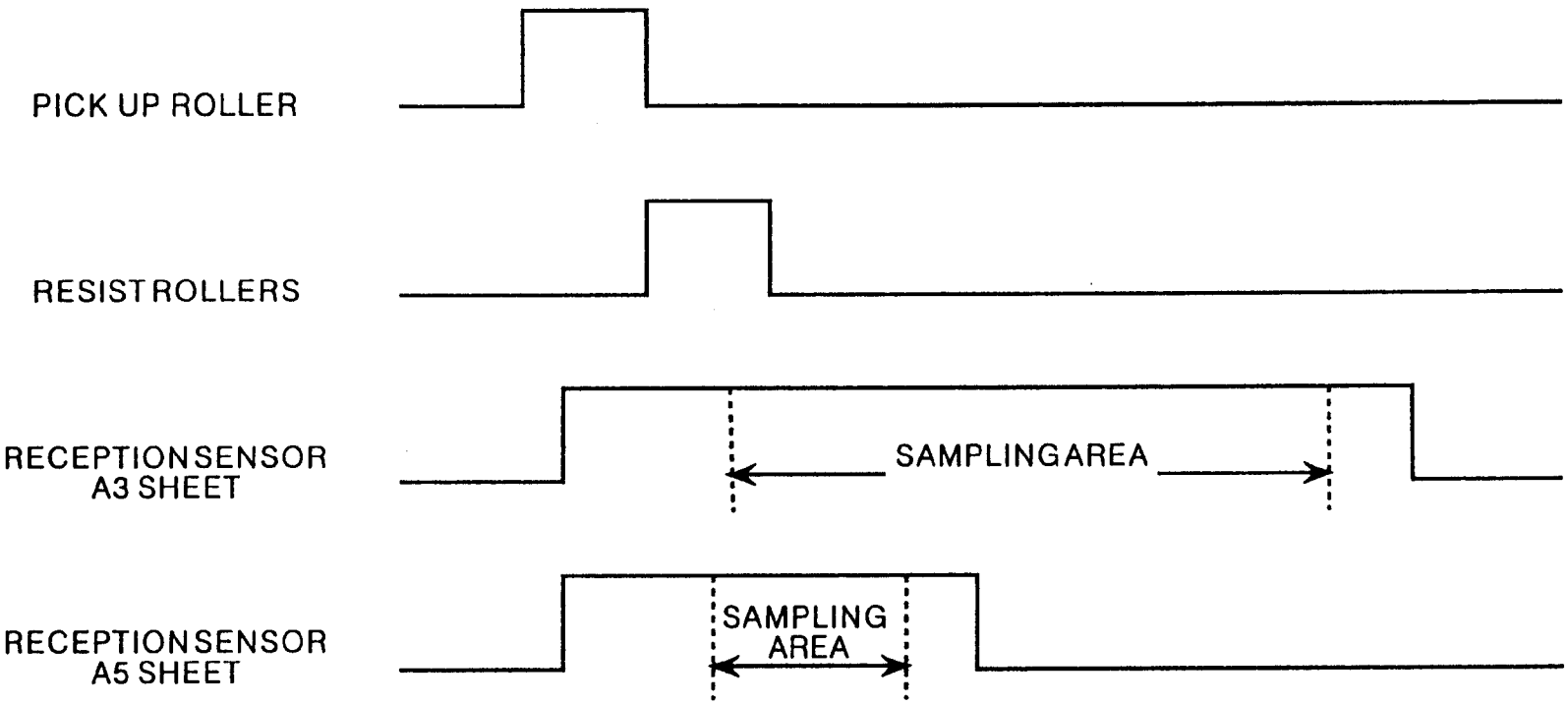
FIG. 22 is a timing chart of the paper feed mechanism for the sheets of different sizes.

The pickup motor 6*a* is driven for 300 ms until the leading end of the sheet 11 is brought into abutment against the contact portion of the resist rollers 9*a* and 9*b* and slack is formed in the sheet 11 as shown in FIG. 20 (ST48) and then stopped (ST49).

Thereafter the resist motor 6*b* is turned on (ST50) to rotate the resist rollers 9*a* and 9*b* in the directions of arrows shown in FIG. 3, whereby the slackened sheet 11 is fed out toward the printing section (printing drum) not shown. In this embodiment, the sheet 11 is fed into the printing section solely by the resist rollers 9*a* and 9*b*.

Upon turning on the resist motor 6*b*, the paper counter in the CPU 16 is cleared to 0 (ST51). When the count of the paper counter amounts to the sampling start value (ST52:YES), the sheet thickness detecting means 1 is caused to sample in the direction of conveyance over the sampling area determined taking the point at which the counter is cleared as the leading end of the sheet 11.

In this sampling, light emitted from the light emission sensor 1*a* passes through the sheet 11 and impinges upon the light reception sensor l*b*. The output of the light reception sensor 1*b* is amplified by the amplifier 2 and is converted to a digital signal by the A/D convertor 15. The digital signal is input into the CPU 16 and is stored in the RAM 18 as the sampling data (ST53). Together with the sampling data, the count of the paper counter at that time is stored in the RAM 18 (ST54).

In the sampling, the sampling intervals of the light reception sensor 1*b* is governed by the encoder sensor 7 connected to the resist rollers 9. The encoder sensor 7 outputs a pulse each time the resist rollers 9 rotate by an angle corresponding to feed of the sheet 11 by 1 mm and the pulse signal causes interruption in the CPU 16. The paper counter in the CPU 16 increments the count stored in the RAM 18 by one each time an interruption signal is input from the encoder sensor 7 (ST55). The sampling intervals may be controlled on the basis of time so that the sampling occurs at regular time intervals.

The sampling is repeated until the count of the paper counter amounts to the sampling ending value. When the count of the paper counter amounts to the sampling ending value (ST56:YES), the sheet 11 is further conveyed by 60 mm (the trailing end portion 50 mm+margin 10 mm), and thus conveyance by the resist rollers 9 is ended (ST57). Thereafter, the resist motor 6*b* is stopped (ST58) and printing is carried out (ST59).

When the stop key 12*b* is pushed after printing (ST60:YES), the system is initialized. When the stop key 12*b* is not pushed (ST60:NO), the second uppermost sheet 11 is taken up and sampling is carried out on the sheet 11 over the sampling area determined. That is, the pickup motor 6*a* is turned on (ST61) to rotate the pickup roller 8 for 300 ms until the leading end of the sheet 11 is brought into abutment against the contact portion of the resist rollers 9*a* and 9*b* and slack is formed in the sheet 11 (ST62) and then stopped (ST63).

Thereafter the resist motor 6*b* is turned on (ST64) to rotate the resist rollers 9*a* and 9*b*, thereby feeding the slackened sheet 11 toward the printing section not shown. Upon turning on the resist motor 6*b*, the paper counter in the CPU 16 is cleared to 0 (ST65).

When the count of the paper counter amounts to the sampling start value (ST66:YES), the sheet thickness detecting means 1 is caused to sample in the direction of conveyance over the sampling area determined taking the point at which the counter is cleared as the leading end of the sheet 11 (ST67 to ST69).

When the count of the paper counter amounts to the sampling ending value (ST70:YES), it is determined whether multiple feed occurs through comparison of the current sampling data with the preceding sampling data (ST71). When the current sampling data represents that the amount of light received by the light reception sensor 1*b* is substantially smaller than that represented by the preceding sampling data, it is determined multiple feed occurs. The determination may be made, for instance, by comparison of the averages of the current and preceding sampling data, comparison of selected values of the current and preceding sampling data, or comparison of values of a plurality of corresponding values of the current and preceding sampling data. In any event, since the sampling data is obtained for a plurality of points in the direction of conveyance, determination of multiple feed can be made taking into account the state over the entire sampling area and accordingly, even if the sheet 11 bears printing on the back side thereof, there is little fear that wrong determination can be made due to shift of the sampling points.

The processing in ST61 to ST70 is the same as that in ST47 to ST56.

When it is determined that multiple feed occurs (ST71:YES), the alarm lamp 14 on the control panel 3 is turned on to inform the user of occurrence of multiple feed and to cause the user to interrupt printing. Then the resist motor 6*b* is turned off (ST73) and the system is initialized.

On the other hand, when it is not determined that multiple feed occurs (ST71:NO), the sheet 11 is further conveyed by 60 mm, and thus conveyance by the resist rollers 9 is ended (ST74). Thereafter, the resist motor 6*b* is stopped (ST75) and printing is carried out (ST59). Then when the stop key 12*b* is pushed after printing, printing is terminated and otherwise paper feed is repeated.

Though in the embodiments described above, the paper feed table 19 which is movable up and down is employed as the container for a sheet stack, other known means for containing the sheet stack such as known cassettes may be employed so long as the sheet size in the direction of conveyance can be detected.

Figure 13:
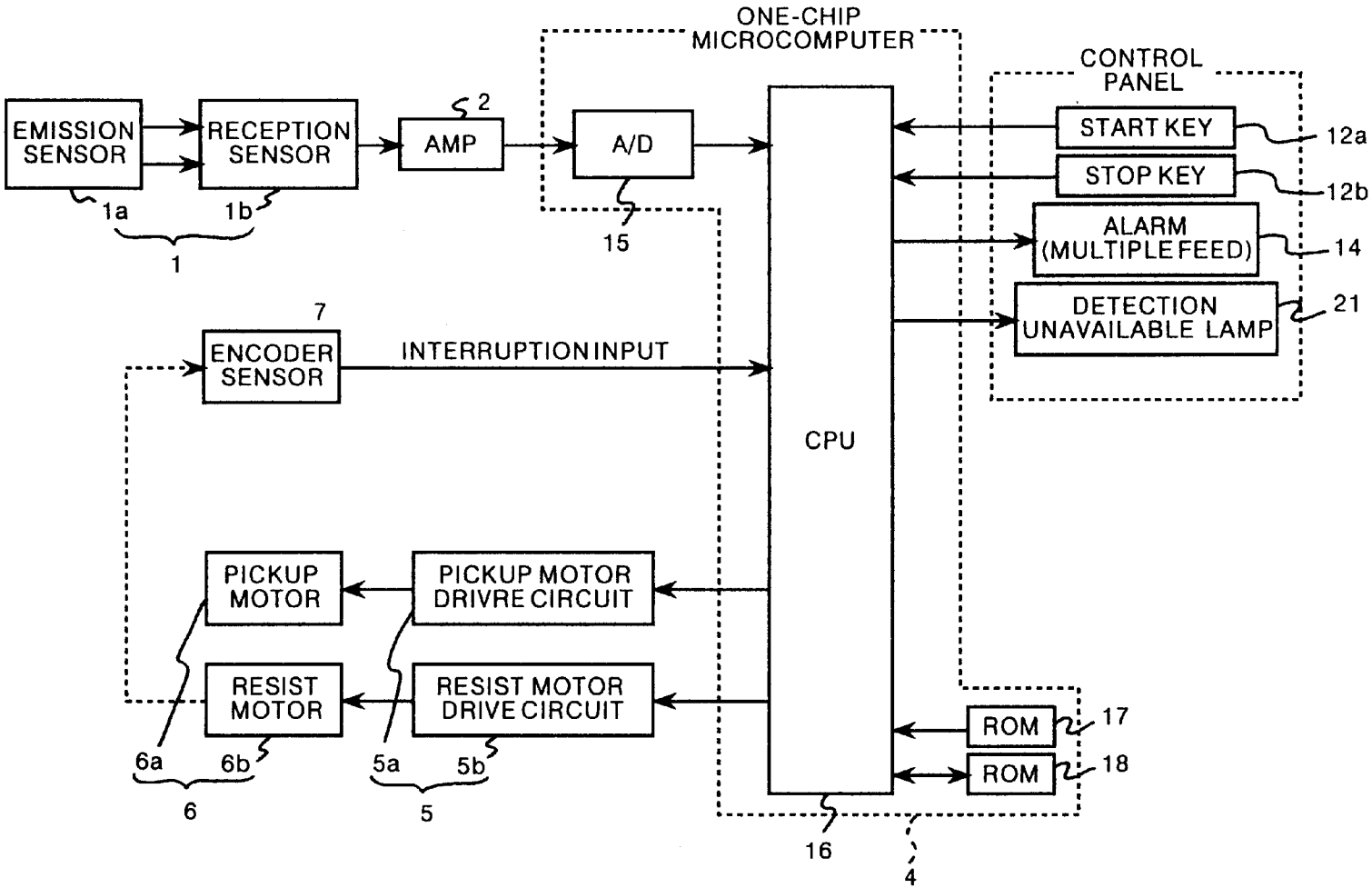
FIG. 13 is a block diagram showing a multiple feed detecting system in accordance with a third embodiment of the present invention.
Figure 14:
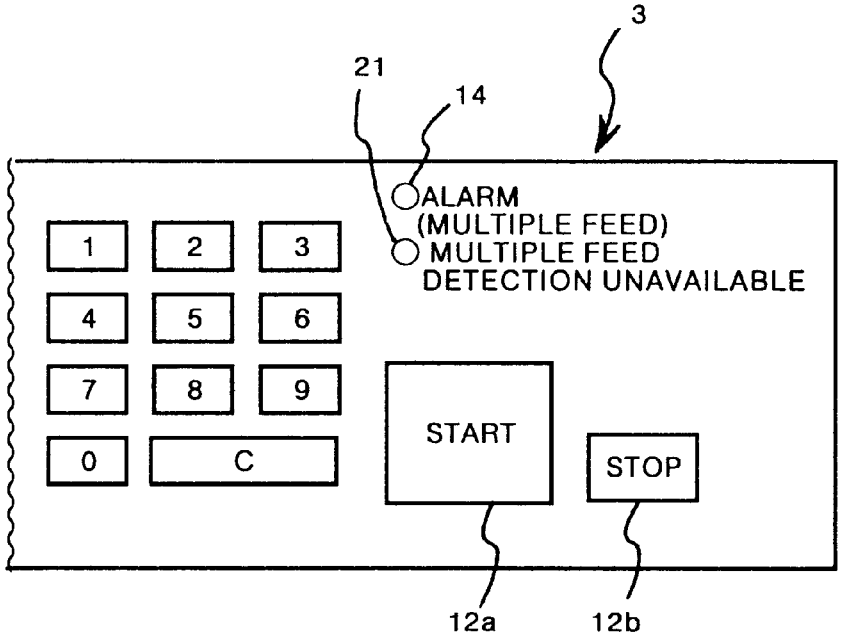
FIG. 14 is a view of a control panel employed in the third embodiment.

Third Embodiment A multiple feed detecting system in accordance with a third embodiment of the present invention will be described with reference to FIGS. 13 and 14, hereinbelow. The elements analogous to those of the first embodiment are given the same reference numerals and will not be described here.

In the third embodiment, the control panel 3 is not provided with the sheet size key and the sheet size lamp which are provided in the first embodiment and is provided with a multiple feed detection unavailable lamp 21.

In the third embodiment, the signal from the sheet thickness detecting means 1 is sampled at a plurality of points on the sheet 11 in the direction of conveyance and the sheet size is calculated on the basis of the sampling data. The multiple feed detecting unavailable lamp is turned on under the control of the microcomputer when it is determined that detection of multiple feed on the basis of the sampling data is impossible.

The operation of the third embodiment will be described with reference to the flow charts shown in FIGS. 15 to 18, hereinbelow.

In the third embodiment, the sheet size (the length in the direction of conveyance) is detected while the sheet is being fed. That is, the amount of feed of the sheet 11 by the resist rollers 9 from the time the resist rollers 9 is started to the time the trailing end of the sheet passes the light reception sensor 1*b* is taken as the length of the sheet 11 in the direction of conveyance.

It is determined that the trailing end of the sheet has passed the light reception sensor 1*b* when the value of the sampling data obtained by the reception sensor 1*b* becomes 90% of the value of the sampling data in the state where no sheet exist.

Figure 15:
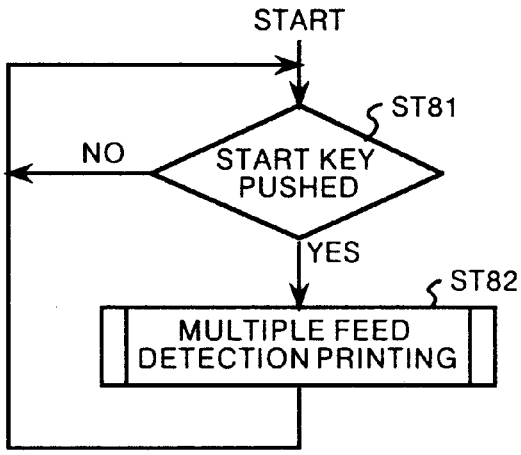
FIG. 15 is a flow chart for illustrating the operation of the third embodiment.
Figure 16:
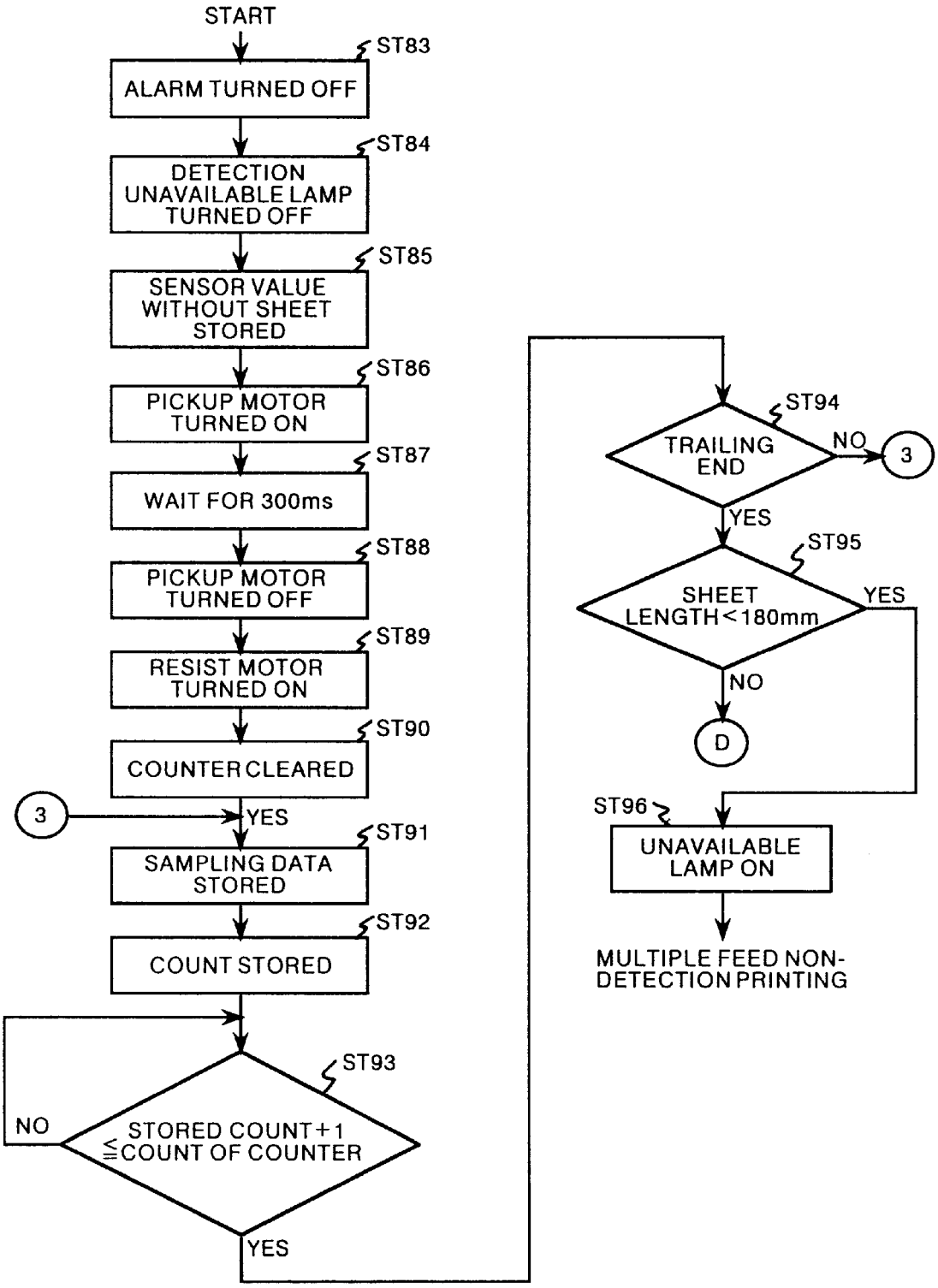
FIGS. 16 to 18 show a flow chart for illustrating the operation of detecting multiple feed and printing in the third embodiment.
Figure 17:
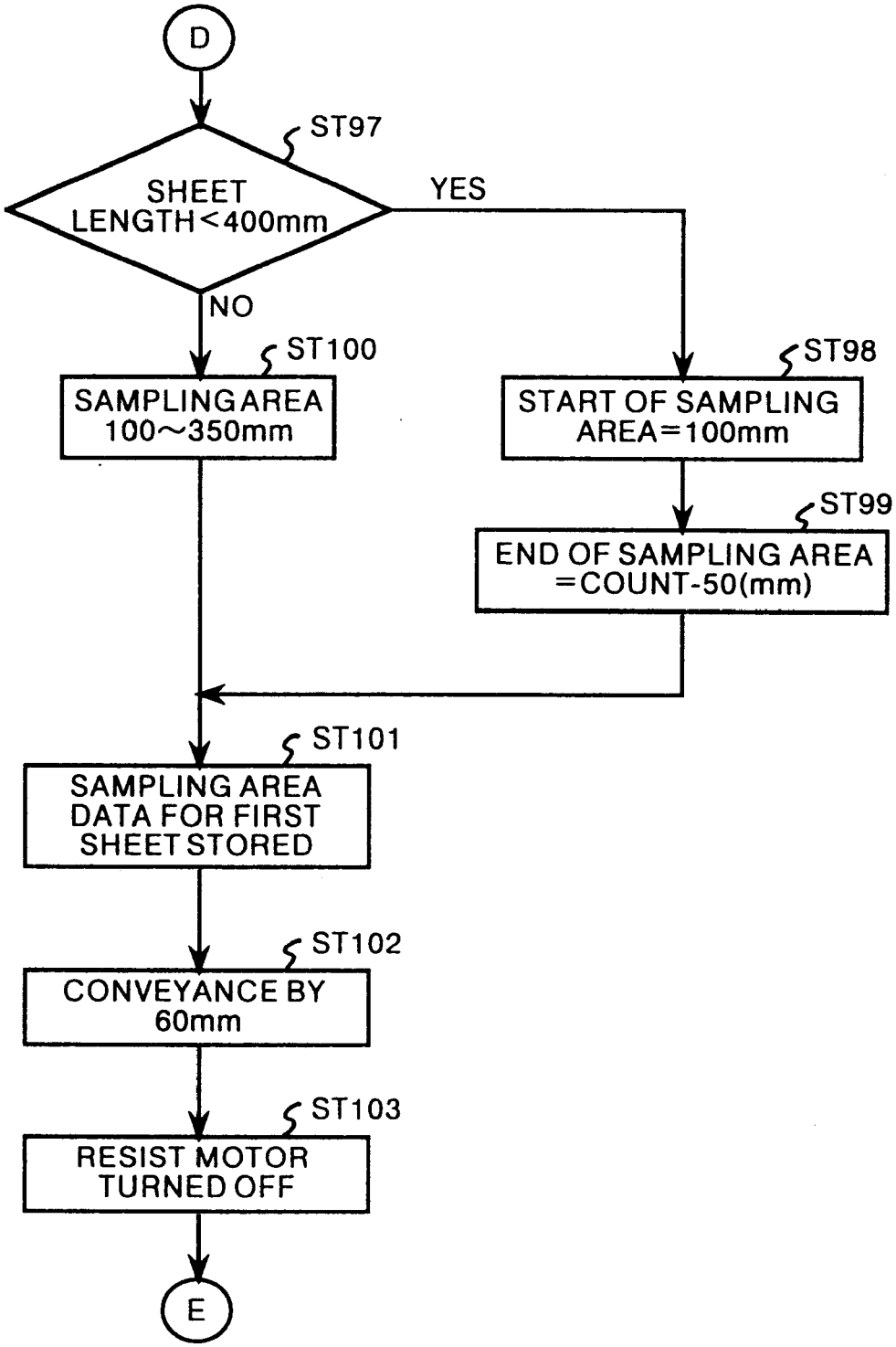
Figure 18:
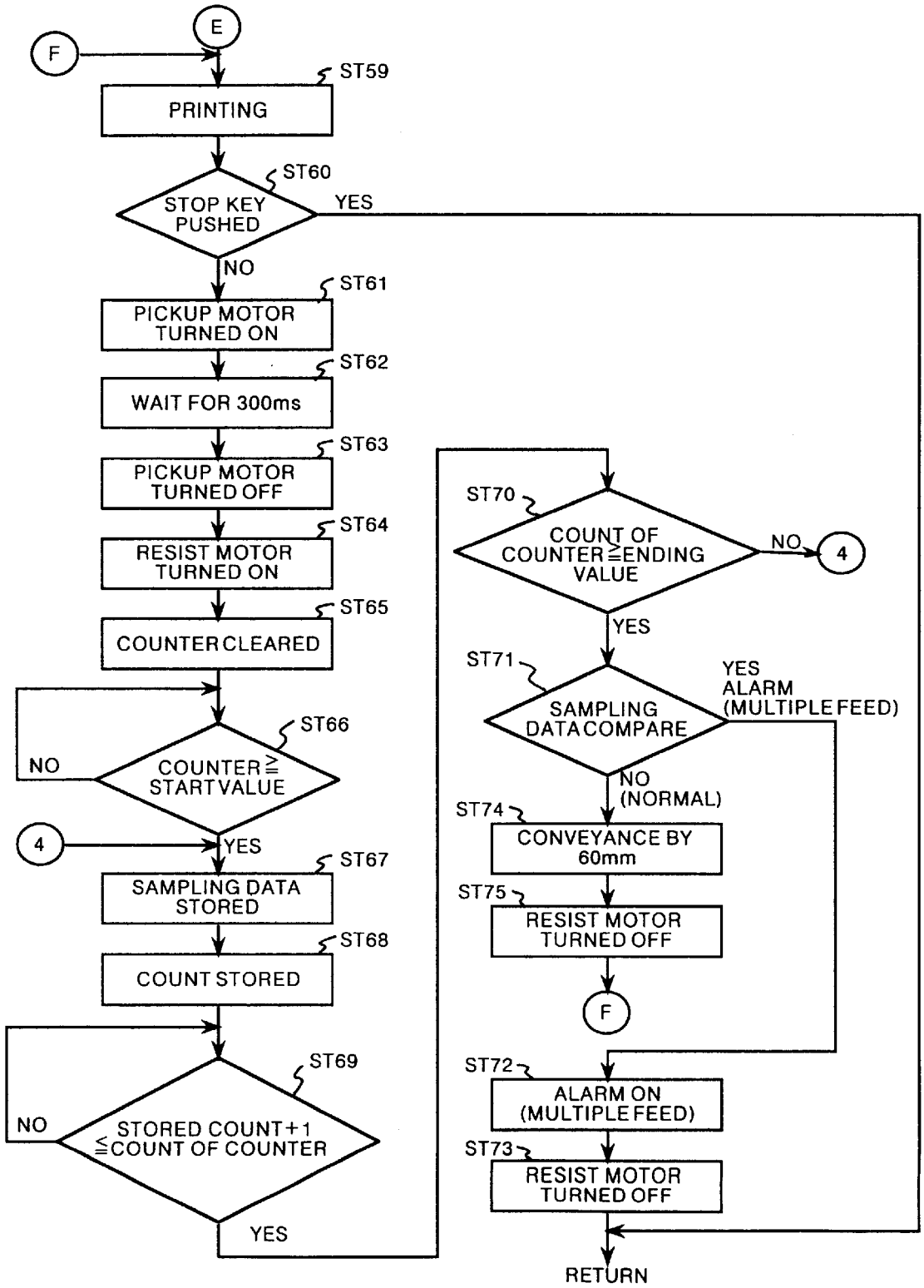
Figure 19:
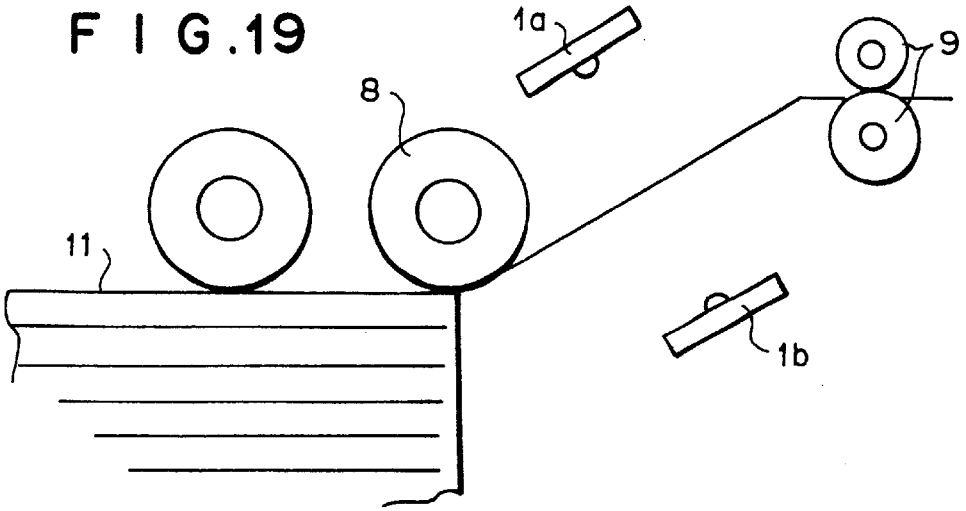
FIG. 19 is a view showing a state where a light transmission type multiple feed detector is provided to a paper feed mechanism.

In the flow chart shown in FIG. 15, when the start key 12*a* is pushed (ST81:YES), the operation of multiple feed detection printing shown in FIGS. 16 to 18 is carried out (ST82).

In the operation of multiple feed detection printing, when the multiple feed alarm lamp 14 and the multiple feed detection unavailable lamp 21 have been on, the lamps 14 and 21 are turned off (ST83, 84). The sampling data by the light reception sensor 1*b* in the state where there is no sheet on the path of conveyance between the light emission sensor 1*a* and the light reception sensor 1*b* is stored in the RAM 18 (ST85).

Then the pickup motor 6*a* is turned on (ST86) to rotate the pickup roller 8 for 300 ms until the leading end of the sheet 11 is brought into abutment against the contact portion of the resist rollers 9*a* and 9*b* and slack is formed in the sheet 11 (ST87) and then stopped (ST88).

Thereafter the resist motor 6*b* is turned on (ST89) to rotate the resist rollers 9*a* and 9*b*, thereby feeding the sheet 11 toward the printing section not shown. Upon turning on the resist motor 6*b*, the paper counter in the CPU 16 is cleared to 0 (ST90).

Then the sampling data by the light reception sensor 1*b* while the sheet 11 is being conveyed is stored in the RAM 18 (ST91). Then the count of the paper counter in the CPU 16 is stored (ST92). When the resist rollers 9 rotate to feed the sheet 11 is by 1 mm and an interruption signal is input from the encoder sensor 7, the count of the paper counter is incremented by one (ST93).

When the value of the sampling data obtained by the reception sensor 1*b* becomes not lower than the reference value (90% of the value of the sampling data in the state where no sheet exist) and it is determined that the trailing end of the sheet has passed the light reception sensor 1*b* (ST94:YES), it is determined whether the length of the sheet 11 is sufficient to detect multiple feed, that is, whether it is shorter than 180 mm (ST95).

When it is determined that the length of the sheet 11 is shorter than 180 mm (ST95:YES), that is, when detection of multiple feed is impossible, the detection unavailable lamp 21 is turned on (ST96).

When the length of the sheet is not shorter than 180 mm (ST95:NO), it is determined whether the length of the sheet 11 is shorter than 400 mm (ST97).

When the length of the sheet is shorter than 400 mm (ST97:YES), the start of the sampling area is determined to be at a distance of 100 mm from the leading end of the sheet (ST98). The end of the sampling area is determined to be a position corresponding to the value obtained by subtracting 50 mm from the count of the paper counter (ST99).

When the length of the sheet is not shorter than 400 mm, the sampling area is determined to be from 100 to 350 mm (ST100).

The data thus determined is stored in the RAM 18 as the data on the sampling area for the first sheet (ST101). Then the sheet 11 is further conveyed by 60 mm (the trailing end portion 50 mm+ margin 10 mm), and thus conveyance by the resist rollers 9 is ended (ST102). Thereafter, the resist motor 6*b* is stopped (ST103) and printing is carried out (ST59). The printing operation is the same as in the first and second embodiments and accordingly the steps analogous to those in the first and second embodiments are given the same reference symbols and will not be described here.

The first embodiment is provided with a sheet size key for designating the size of the sheet in the direction of conveyance and the second embodiment is provided with a sheet size sensor for detecting the size of the sheet in the direction of conveyance, and the sampling area over which the sheet thickness detecting means 1 samples is determined on the basis of the sheet size. Accordingly, a sampling area optimal for each size of the sheet can be obtained and multiple feed detection can be effected at a high accuracy.

In the third embodiment, since the sheet thickness detecting means 1 samples at a plurality of points on the sheet 11 in the direction of conveyance in the sampling area determined while the sheet 11 is being conveyed, and the sheet size is calculated on the basis of the sampling data, and the data on the area obtained by subtracting from the sheet size the instable areas in the leading and trailing end portions of the sheet is used for detecting multiple feed, setting of the sampling area for multiple feed detection and detection of multiple feed can be automatically performed without operator and an optimal sampling area can be obtained according to the sheet size and multiple feed detection can be carried out at a high accuracy.

Though, in the third embodiment, the length of the sheet in the direction of conveyance is detected for the first sheet and it is assumed that the second sheet and the followings are the same length as the first sheet, the sheet length detection may be carried out for each sheet.

In the third embodiment, the sampling area for multiple feed detection is basically from a position at a distance of 100 mm from the leading end for each sheet size to a position at a distance of 50 mm from the trailing end.

However in the case of a sheet shorter than 180 mm, the sampling area is too narrow and accordingly, printing is carried out without detecting multiple feed. Further in the case of a sheet not shorter than 400 mm, the sampling area is limited in view of the capacity of the sampling data and/or the processing speed of the CPU as in the first and second embodiments.

Though, being positioned between the pickup roller and the resist rollers in the embodiments described above, the sheet thickness detecting means may be positioned other positions. For example, when the sheet thickness detecting means is positioned on the path of conveyance to the printing section where the sheet is conveyed flat, multiple feed of the sheets can be detected more accurately.

Further the sheet thickness detecting means may be provided in a plurality of places along the path of conveyance.

In the embodiments described above, multiple feed detection is made on the basis of comparison of the sampling data for the current sheet with that for the first sheet. However multiple feed detection may be made on the basis of comparison of the sampling data for the current sheet with that for the immediately preceding sheet.

The sheet thickness detecting means may be other than the transmission type sensor comprising the light emission sensor 1*a* and the light reception sensor 1*b* described above. For example, when a reflective type sensor comprising a light emission sensor and a light reception sensor provided side by side is employed, it is disposed above or below the path of conveyance 10 so that light emitted from the light emission sensor is received by the light reception sensor.

When an ultrasonic sensor is employed as the sheet thickness detecting means 1, a pair of ultrasonic sensors are disposed opposed to each other with a sheet 11 conveyed along the path of conveyance 10 intervening therebetween and an ultrasonic wave generated from one of the sensors is received by the other sensor through the sheets 11.

When a contact type sensor is employed as the sheet thickness detecting means 1, one of a pair of rollers which pinch a sheet 11 therebetween and convey the sheet 11 is made to be movable up and down and the movement of the roller is detected by a sensor.

When a photosensor of the transmission type or reflective type is employed as the sheet thickness detecting means, the output of the sensor when a single sheet is conveyed must differ from that when a plurality of sheets are conveyed at one time.

As can be seen from the description above, in accordance with the present invention, an optimal sampling area can be obtained according to the sheet size and multiple feed detection can be carried out at a high accuracy.

In accordance with the feature defined in Claim 2 of the appended Claims, by designating the sheet size by simply operating the sheet size key, a sampling area optimal to the designated sheet size can be obtained.

In accordance with the feature defined in Claim 3 of the appended Claims, by detecting the sheet size on the sheet feed table, a sampling area optimal to the detected sheet size can be obtained on the basis of the sheet size information.

In accordance with the feature defined in Claim 4 of the appended Claims, the sheet size in the direction of conveyance is determined on the basis of the sampling data by the sheet thickness detecting means and a sampling area optimal to the detected sheet size can be obtained.

In accordance with the feature defined in Claim 5 of the appended Claims, since multiple feed is detected by comparison of sets of data on the area other than the instable areas unsuitable for sampling, detection of multiple feed can be accurately carried out.

In accordance with the feature defined in Claim 6 of the appended Claims, multiple feed can be detected near the source of the sheet.

What is claimed is:

1. A multiple feed detecting system comprising a sheet thickness detecting means which outputs thickness signals representing the thickness of a sheet to be conveyed, a sheet size detecting means which detects the size of the sheet to be conveyed as measured in the direction of conveyance, and a processing means which sets a detecting area according to the size of the sheet detected by the sheet size detecting means and determines whether multiple feed occurs on the basis of sampling data obtained by the sheet thickness detecting means over the detecting area.

2. A multiple feed detecting system as defined in claim 1 in which the sheet size detecting means outputs a sheet size signal according to sheet size selected on a control panel.

3. A multiple feed detecting system as defined in claim 1 in which the sheet size detecting means is provided on a container in which the sheets to be conveyed are contained and outputs a sheet size signal representing the size of the sheets in the direction of conveyance contained in the container.

4. A multiple feed detecting system as defined in claim 1 in which the processing means determines the sheet size in the direction of conveyance according to sampling data obtained by the sheet thickness detecting means and changes the detecting area of the sheet thickness detecting means according to the sheet size thus determined.

5. A multiple feed detecting system as defined in claim 1 in which the processing means determines whether multiple feed occurs on the basis of comparison of the sampling data for the current sheet obtained by the sheet thickness detecting means over the detecting area with the sampling data for a preceding sheet obtained by the sheet thickness detecting means over the detecting area.

6. A multiple feed detecting system as defined in claim 1 in which the sheet thickness detecting means is provided on a path of conveyance between a first conveyance means which separates a sheet from a sheet stack on a stack table and conveys the separated sheet and a second conveyance means which receives the sheet conveyed from the first conveyance means and conveys it downstream.

7. A multiple feed detecting system as defined in claim 1 in which the sheet thickness detecting means comprises a light transmission type sensor.

8. A multiple feed detecting system as defined in claim 1 in which the sheet thickness detecting means comprises a light reflection type sensor.

9. A multiple feed detecting system as defined in claim 1 in which the sheet thickness detecting means comprises an ultrasonic sensor.

10. A multiple feed detecting system as defined in claim 1 in which the sheet thickness detecting means comprises a contact type sensor.

* * * * *